US006920839B2

(12) United States Patent
Pelley

(10) Patent No.: US 6,920,839 B2
(45) Date of Patent: Jul. 26, 2005

(54) LIFEBOAT RELEASE MECHANISM

(76) Inventor: Dean M. Pelley, 312 Windgap Road, Flat Rock (CA), A1K 1C3

( * ) Notice: Subject to any disclaimer, the term of this patent is extended or adjusted under 35 U.S.C. 154(b) by 0 days.

(21) Appl. No.: 10/922,969

(22) Filed: Aug. 23, 2004

(65) Prior Publication Data

US 2005/0051079 A1 Mar. 10, 2005

Related U.S. Application Data

(60) Provisional application No. 60/500,251, filed on Sep. 5, 2003.

(51) Int. Cl.[7] ..... B63B 23/00

(52) U.S. Cl. ..... 114/378; 294/82.27

(58) Field of Search ..... 114/377, 378, 114/379, 380; 294/82.27, 82.31, 82.33

(56) References Cited

U.S. PATENT DOCUMENTS

| | | | | |
|---|---|---|---|---|
| 60,963 A | | 1/1867 | Taylor | |
| 60,964 A | | 1/1867 | Taylor | |
| 60,965 A | | 1/1867 | Taylor | |
| 60,966 A | | 1/1867 | Taylor | |
| 61,279 A | | 1/1867 | Taylor | |
| 61,280 A | | 1/1867 | Taylor | |
| 61,281 A | | 1/1867 | Taylor | |
| 1,030,586 A | | 6/1912 | Irwin | |
| 2,618,792 A | | 11/1952 | Vreugdenhil | |
| 4,201,410 A | | 5/1980 | Crawford | |
| 4,281,867 A | * | 8/1981 | Kariagin | 294/82.33 |
| 4,358,146 A | | 11/1982 | Goudey | |
| 4,610,474 A | | 9/1986 | Jaatinen | |

* cited by examiner

*Primary Examiner*—Ed Swinehart
(74) *Attorney, Agent, or Firm*—Mario Theriault

(57) ABSTRACT

The lifeboat release mechanism has a hook movably mounted therein. This hook has a concave surface on its lower end. A latch block having a convex surface thereon is also movably mounted therein. In a holding mode, the convex surface of the latch block is laid against the concave surface of the hook. In a release mode, the convex surface is below the concave surface. In a first aspect of the invention, the concave surface extends above and below an axis of rotation of the latch block to prevent an unattended release of the mechanism. In another aspect, the concave surface and the convex surface have a same radius of curvature to prevent localized wear thereon. In a third aspect, the latch lock is rotatable over an angular displacement of 80° between a holding position and a release position, such that the releasing of the mechanism is predictable.

20 Claims, 4 Drawing Sheets

LIFEBOAT RELEASE MECHANISM

FIELD OF THE INVENTION

This invention pertains to lifeboat release mechanisms, and more particularly it pertains to lifeboat release mechanisms having mating concave and convex parts.

BACKGROUND OF THE INVENTION

A twin fall davit lifeboat or a totally enclosed motor propelled survival craft is used to evacuate personnel from an offshore oil drilling platform or a marine vessel. This type of lifeboat system has release mechanisms that disengage the lifeboat from the davit lines when the craft reaches or is just above the water. Regulations state that the release mechanisms on a lifeboat must be operable with the full weight of the lifeboat on the davit lines. Although this regulation has been drafted to ensure that a lifeboat will be positively released when the release mechanisms are operated, there has been and continues to be, isolated cases of malfunctions of the release mechanisms, including cases of premature releases at some undesirable distance above the water.

Generally, the lifeboat release mechanisms of the prior art have interlocking parts including hooks to which are attached the ropes supporting the lifeboat. These hooks are allowed to pivot in such a way as to release the ropes of the lifeboat upon a rotation thereof from their holding positions. Each hook is held in its holding position by a catch member. In some of the prior art devices, the engagement of the hook with the catch member is very small such that when the catch member is moved even by a slight amount, the hook is released and pivots on itself, thereby releasing the lifeboat line unexpectedly.

Examples of lifeboat release mechanisms of the prior art are shown in the following documents:

U.S. Pat. No. 60,963 issued to James R. Taylor on Jan. 1, 1867;

U.S. Pat. No. 60,964 issued to James R. Taylor on Jan. 1, 1867;

U.S. Pat. No. 60,965 issued to James R. Taylor on Jan. 1, 1867;

U.S. Pat. No. 60,966 issued to James R. Taylor on Jan. 1, 1867;

U.S. Pat. No. 61,279 issued to James R. Taylor on Jan. 15, 1867;

U.S. Pat. No. 61,280 issued to James R. Taylor on Jan. 15, 1867;

U.S. Pat. No. 61,281 issued to James R. Taylor on Jan. 15, 1867;

U.S. Pat. No. 1,030,586 issued to J. Irwin on Jun. 25, 1912;

U.S. Pat. No. 2,618,792 issued to A. Vreugdenhil on Nov. 25, 1952;

U.S. Pat. No. 4,201,410 issued to H. Crawford et al. on May 6, 1980;

U.S. Pat. No. 4,358,146 issued to C. A. Goudey on Nov. 9, 1982;

U.S. Pat. No. 4,610,474 issued to J. Jaatinen on Sep. 9, 1986.

In the devices of U.S. Pat. No. 1,030,586 and U.S. Pat. No. 4,358,146, in particular, the catch members are held in a holding position by cams and springs. In another type, as illustrated and described in U.S. Pat. No. 4,201,410, a pair of levers must be pulled in sequence with each other to release the catch member. The device of U.S. Pat. No. 4,610,474 has an hydraulic cylinder which is used to retain a catch member in its holding position.

A lifeboat is exposed to sea water and harsh weather conditions. The lifeboat and its release mechanisms are repainted periodically to limit their deterioration by corrosion. During winter, a layer of ice accumulates on every part of a lifeboat and on its release mechanisms. Therefore a release mechanism must be operable when covered with ice, when partly corroded and after having been repainted several times.

Because of their exposure to the elements, these lifeboat release mechanisms should not contain small springs, roller bearings, small gears, small levers and pins, sprockets and chains, hydraulic or pneumatic equipment, or other mechanical parts which are susceptible to seize in a corrosive environment or to jam when covered with ice.

Another preferred feature of a lifeboat release mechanism is that the engaging surfaces thereof should be as large as possible to prevent wear of its components after several years in service. The engagement surfaces between the latch members and the catch members in the release mechanisms of the prior art are often very small, such as a roller held against a relatively flat surface. A lifeboat suspended to a twin fall davit is often in motion from the force of the wind and the rocking of the vessel to which it is attached. Also, the vibrations of the engine of the vessels and of its propellers are transmitted through the vessel and into the release mechanisms of the lifeboat. These vibrations and the oscillatory motion of the lifeboat eventually wear out the engaging surfaces of the components of the release mechanisms, and where a hard roller bears against a flat surface, a flat spot is formed on the roller, or a notch is formed in the flat surface. It is believed that this type of wear in a lifeboat release mechanism is often the cause of malfunction of the release mechanism.

Accordingly, it may be appreciated that there continues to be a need for a new and improved lifeboat release mechanism that has a predictable unlatching movement, that contains no springs or similar small parts and that has large engagement surfaces of its elements to avoid localized wear.

SUMMARY OF THE INVENTION

The lifeboat release mechanism according to the present invention has a sturdy construction with large engaging surfaces of its elements. The release mechanism is free of small intricate parts susceptible of malfunction when corroded or covered with ice. The unlatching of the release mechanism is effected by turning an actuator with a substantially constant force over a displacement of about one quarter of a turn, thereby providing a predictable release point.

In a first aspect of the present invention, there is provided a lifeboat release mechanism comprising a hook having a concave surface on its lower end and a lower tip on this concave surface. A pair of side plates enclose the hook and each side plate has a circular opening there through. A pivot pin extends through the side plates above the circular openings and through the upper end of the hook. The hook is rotatable about that pivot pin from a holding position to a release position. The lifeboat release mechanism also comprises a latch block mounted between the side plates. This latch block has a convex surface thereon facing against a release direction of the lower end of the hook. A pair of bearing discs are mounted in the circular openings of the side plates and are affixed to the latch block. The bearing discs are rotatable in the circular openings about a common axis of rotation.

In this first aspect of the present invention, the convex surface of the latch block is mounted against the concave surface of the hook. The concave surface of the hook extends above and below the common axis of rotation of the bearing discs such that a force on the hook is not transferred as a moment on the bearing discs. This feature prevents any unattended unlatching of the release mechanism.

In another aspect of the present invention, the concave surface on the hook and the convex surface on the latch block have a same radius of curvature, and a same centre of curvature when the lifeboat release mechanism is in a holding mode. The matched curvatures of both pieces ensure large engaging surfaces between these elements to prevent vibration and oscillation-induced wear of these elements.

In yet a further aspect of the present invention, the bearing discs are rotatable to move the latch block from a first position where the convex surface lies against the concave surface for preventing the hook from rotating on the pivot pin, and a second position where the convex surface is below the lower tip of the hook, for allowing a rotation of the hook about the pivot pin. The first position and the second position are about the common axis of rotation of the bearing discs and are separated by an angle of about 80°.

Because latches in general, and especially common door latches have door knobs or handles that are rotatable about a 90° angle, and have been like this for as long as one can remember, it is believed that any latching device having a rotary actuator should have a rotation of about one quarter of a turn in order to provide a predictable release point. Therefore the lifeboat release mechanism according to the present invention with its 80° actuator rotation has a release point that is more predictable than some of the release devices of the prior art.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

One embodiment of the present invention is illustrated in the accompanying drawings, in which like numerals denote like parts throughout the several views, and in which.

DESCRIPTION OF THE PREFERRED EMBODIMENT

Figure 1:
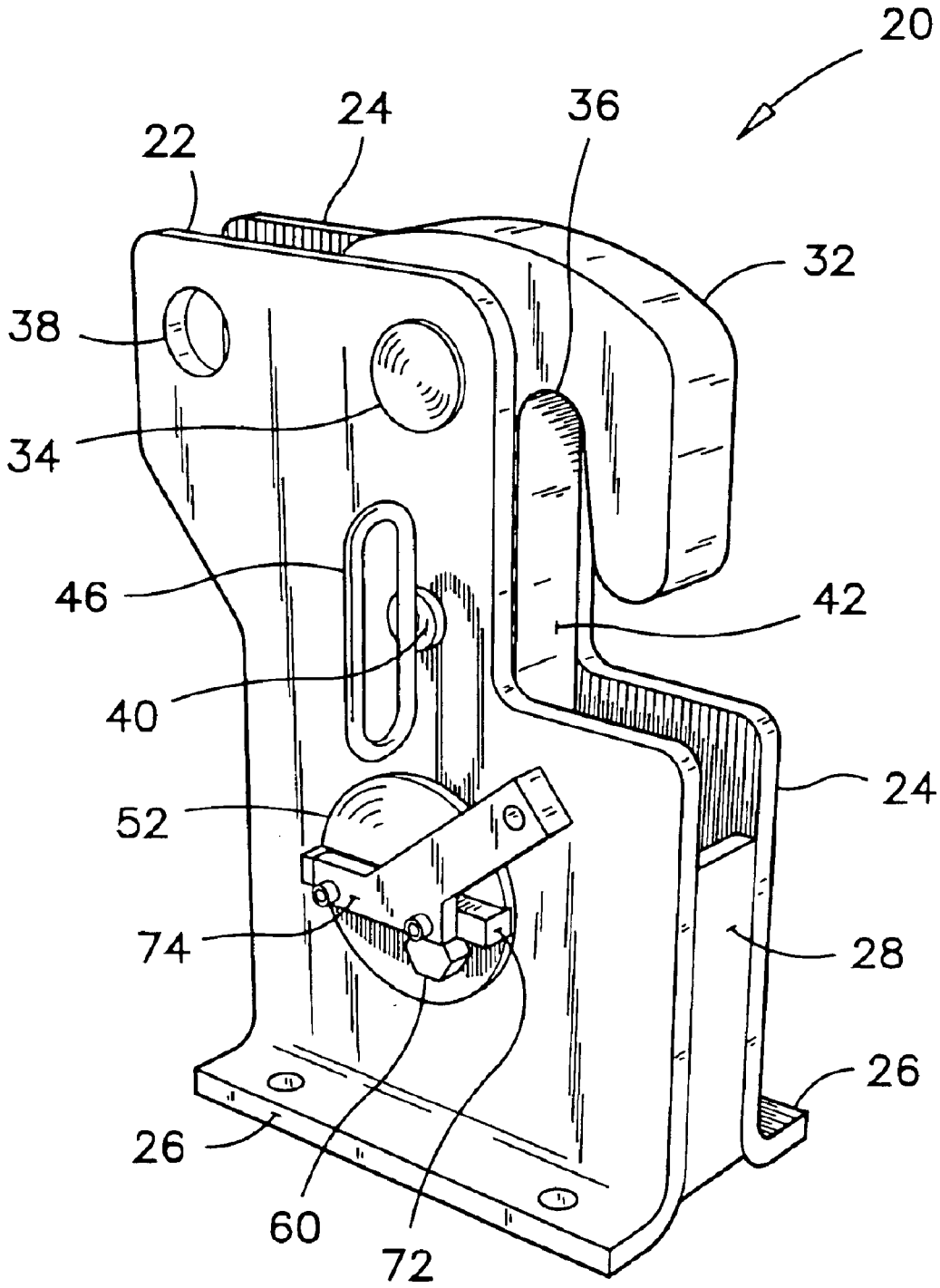
FIG. 1 is a perspective front and left side view of the lifeboat release mechanism according to the preferred embodiment of the present invention.

While this invention is susceptible of embodiment in many different forms, there is shown in the drawings and will be described in details herein one specific embodiment, with the understanding that the present disclosure is to be considered as an example of the principles of the invention and is not intended to limit the invention to the embodiment illustrated and described.

Figure 2:
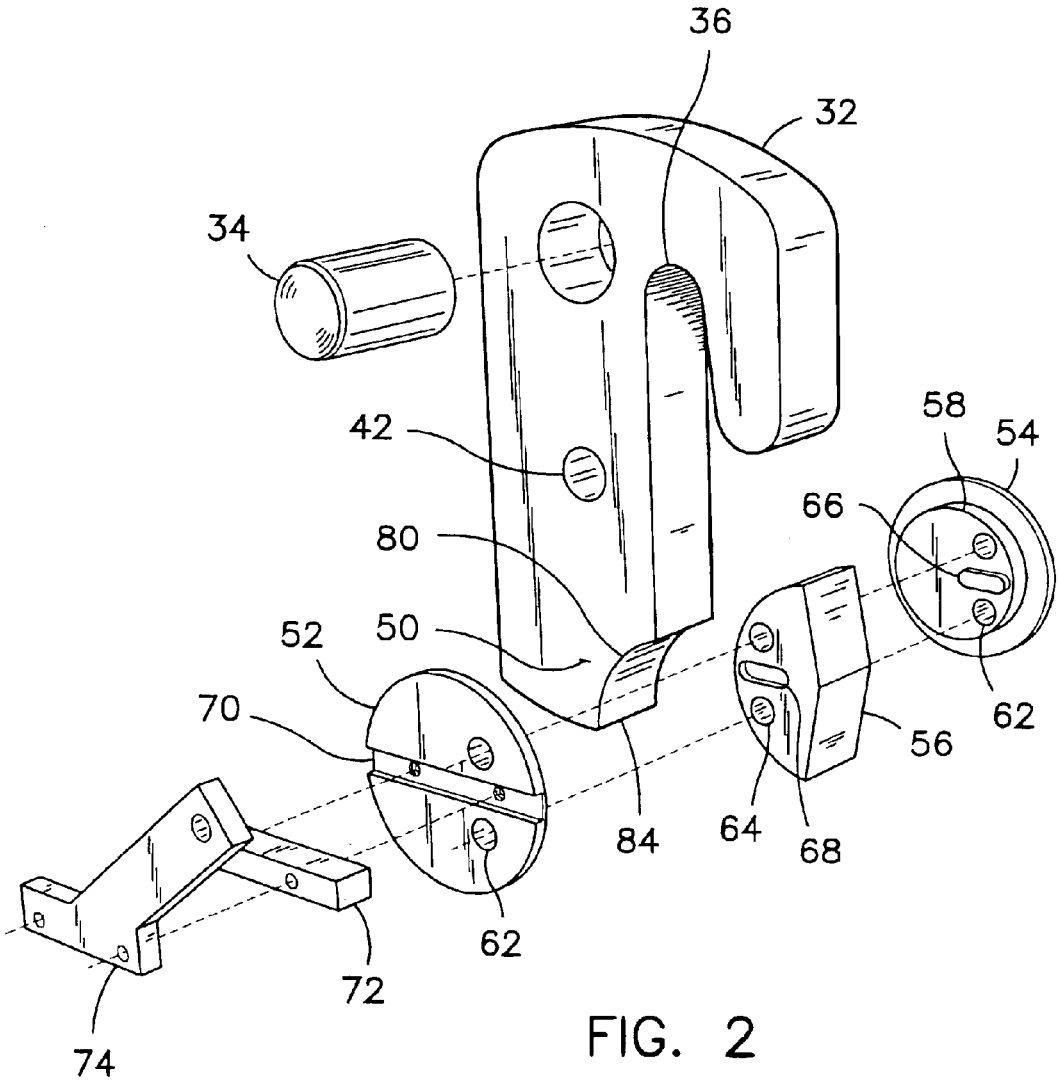
FIG. 2 is an exploded view the preferred lifeboat release mechanism without the side plates and the safety pin thereof.
Figure 3:
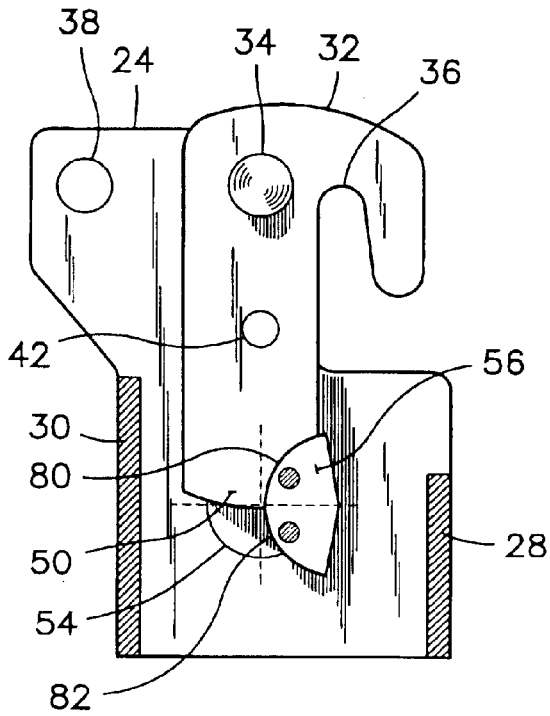
FIG. 3 is a side view of the preferred lifeboat release mechanism, shown in the holding mode, with the left side plate removed.
Figure 4:
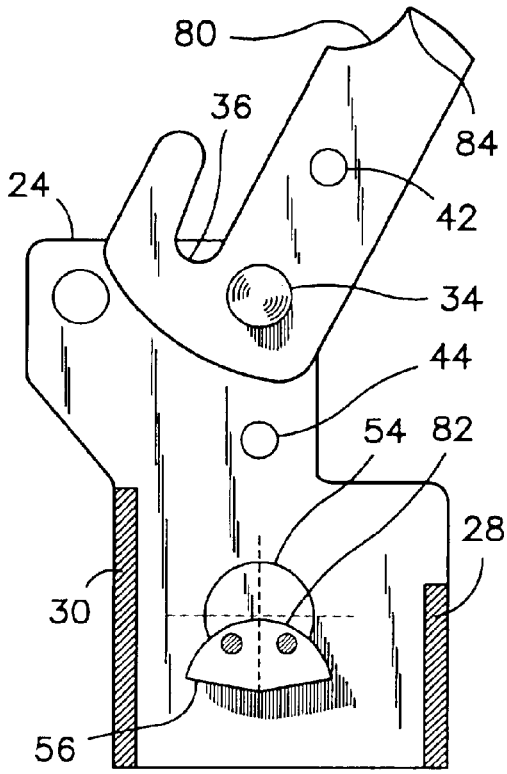
FIG. 4 is a side view of the preferred lifeboat release mechanism, shown in a released mode, with the left side plate removed.
Figure 5:
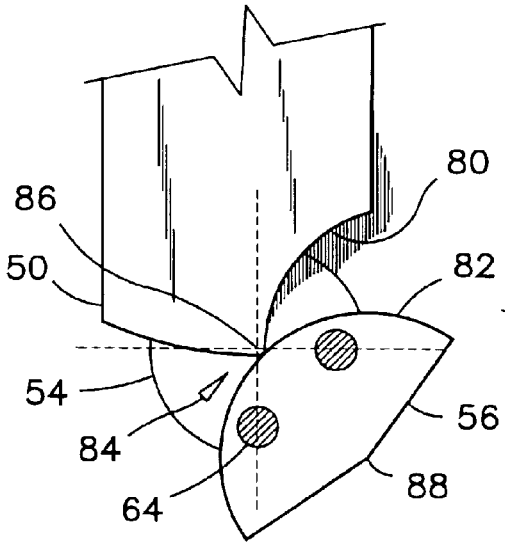
FIG. 5 is an enlarged view of the latch block and the hook heel in an intermediate position between a holding mode and a released mode.

The preferred lifeboat release mechanism 20 is illustrated in its entirety in FIG. 1 while the illustrations of FIGS. 2–4 are provided to explain the interaction of the various structural elements thereof.

The lifeboat release mechanism has a pair of side plates 22, 24 that are fastened to a lifeboat by way of a flange 26 on each side plate. Although a pair of holed flanges 26 are suggested to fasten the release mechanism to a lifeboat by bolts (not shown), it will be appreciated that other attachment means can also be used, depending upon the structure of the lifeboat. The side plates 22, 24 are held in a spaced apart relationship by a front spacer 28, and a similar rear spacer 30 which is partly visible in FIGS. 3 and 4. Both spacers 28, 30 are welded or bolted to the side plates 22, 24 as to form with the side plates, a permanent box-like structure.

The spacers 28 and 30 are referred to herein above as the front and rear spacers respectively, to facilitate the description of the preferred release mechanism. The same convention is maintained throughout the present disclosure.

A hook 32 is mounted between both side plates 22, 24 and is pivoted to the side plates on a pivot pin 34 extending through both side plates. The pivot pin 34 is held axially to the side plates by snap rings, collars or otherwise (not shown). The pivot pin 34 extends through the hook 32 on the rear side of the throat 36 of the hook such that an upward force in the throat 36 of the hook causes a moment about the pivot pin 34 to swing the throat 36 of the hook upside down about the pivot pin 34 when the mechanism is released. In use, the davit lines are attached to the hooks 32 as in other conventional lifeboat release mechanisms. Additional holes 38 are provided in the side plates 22, 24 to retain a safety rope thereto if desired.

The preferred lifeboat release mechanism 20 also has a safety pin 40 extending through both side plates 22, 24 and through a hole 42 in the body of the hook 32. This safety pin 40 is removably mounted through holes 44, as shown in FIG. 4, in the side plates and through the hook. The safety pin 40 has a handle 46 thereon for affording an easy removal thereof prior to unlatching the release mechanism.

The preferred lifeboat release mechanism 20 is characterized mainly by its latching elements. These latching elements are comprised of the hook's heel 50, a pair of bearing discs 52, 54 which are pivoted to the side plates, and a latch block 56 mounted between the bearing discs 52, 54.

Each of the bearing discs 52, 54 has a circular shoulder 58 thereon, and the side plates 22, 24 have circular openings therein to receive these circular shoulders with a free sliding fit, such that the circular shoulders 58 constitute bearing surfaces on which the discs can rotate. Both side plates 22, 24 have a same thickness and the thickness of each circular shoulder 58 is slightly more than the thickness of the side plates 22, 24.

The latch block 56 is fastened to the bearing discs 52, 54 by two bolts 60, one of which is illustrated in FIG. 1, extending though bolt holes 62 through the bearing discs 52, 54 and bolt holes 64 through the latch block 56. The thickness of the latch block 56 is slightly more than the thickness of the hook 32, such that the hook 32 is free to move between the bearing discs 52, 54.

The latch block 56 is further held in a precise position relative to the bearing discs 52, 54 by means of a pair of keys 66, one of which is seen in FIG. 2, protruding from the inside surface of the bearing discs 52, 54, and corresponding inside keyways 68 in the sides of the latch block 56.

An outside keyway 70 is machined on the outside surface of one of the bearing discs, and an outside key 72 is mounted in this keyway 70. A lever 74 or other torque transmission means is fastened to the outside key 72, to rotate the bearing disc 52 and to operate the release mechanism. In use, the lever 74 is attached to a rod or a rope that extends to a location in the lifeboat that is easily accessible to the occupants of the lifeboat, as in other conventional lifeboat release mechanisms.

Referring now to FIGS. 3–8, the characteristics of the preferred lifeboat release mechanism 20 will be explained in greater details.

The heel 50 of the hook has a concave surface 80 thereon and the latch block 56 has a convex surface 82. The concave surface 80 of the hook's heel 50 and the convex surface 82 of the latch block have a same radius of curvature and share a same centre of curvature when the release mechanism is in a latched or holding mode, as illustrated in FIG. 3. The advantage of this arrangement is that the lifeboat release mechanism 20 can withstand years of vibration and oscillation without having a notch or a flat spot worn out on the engaging parts thereof.

The concave surface 80 of the heel 50 has a lower tip 84 that extends slightly below the axis of rotation 86 of the bearing discs 52, 54, as illustrated in FIGS. 3, 5, 6 and 7. This lower tip 84 extending below the axis of rotation 86 prevents a force on the hook from being transmitted as a moment on the latch block 56.

Figure 7:
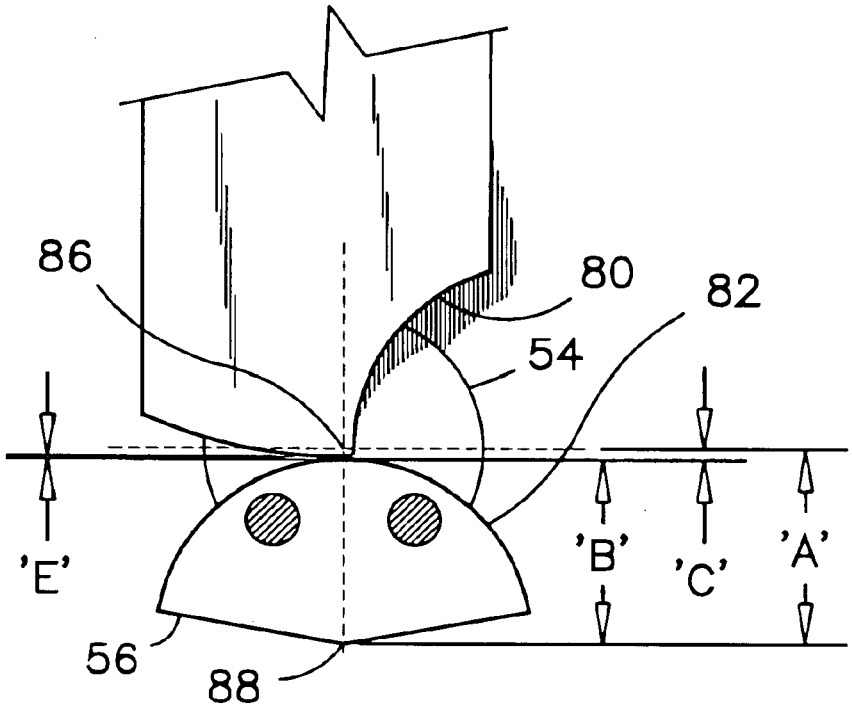
FIG. 7 is an enlarged view of the latch block and the hook heel in a released mode.

The latch block 56 is fastened to both bearing discs 52, 54 such that the axis of rotation 86 of the bearing discs 52, 54 is located along a line passing through the midpoint of the convex surface 82, and the centre of curvature 88 of this convex surface 82. The axis of rotation 86 of the bearing discs 52, 54 is further located at a distance 'A' from the centre of curvature 88 of the convex surface 82 as illustrated in FIG. 7. The distance 'A' is longer than the radius of curvature 'B' of the latch block 56, by an offset dimension 'C' which corresponds substantially to the extent at which the lower tip 84 of the heel projects below the axis of rotation 86 of the bearing discs 52, 54.

Figure 6:
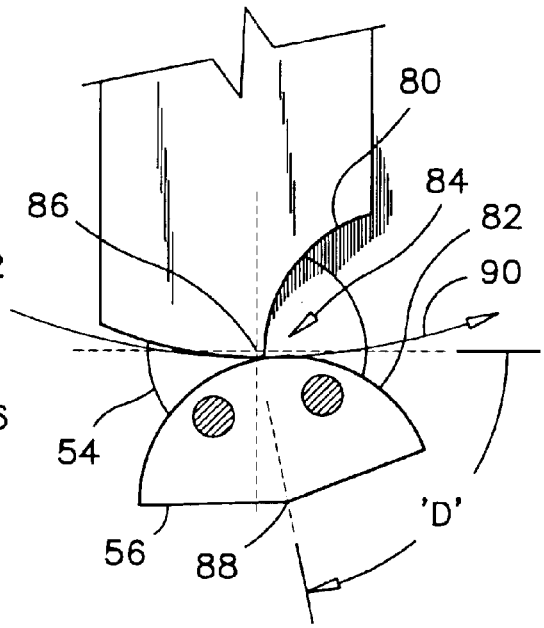
FIG. 6 is an enlarged view of the latch block and the hook heel in an unlatching mode.

It will be appreciated that the unlatching of the release mechanism is effected by rotation of the bearing discs 52, 54 and the latch block 56 about the axis of rotation 86 in the direction of angle 'D' as illustrated in FIG. 6. During the rotation of the latch block 56, the midpoint of the convex surface 82 slides around the tip 84 of the heel 50 to release the hook 32. The hook 32 is then free to pivot about the pivot pin 34 in a release direction 90 opposite the direction of the angle 'D', to release the davit line from the throat 36 thereof.

Theoretically, if the offset dimension 'C' corresponds exactly to the extent at which the tip 84 of the heel 50 projects below the axis of rotation 86 of the bearing discs 52, 54, the angle 'D' of rotation required to release the hook 32 would be exactly one quarter of a turn. However, in practice, it is desirable to incorporate a clearance 'E' between the tip 84 of the hook and the convex surface 82 to prevent any binding of these parts and to ensure a failsafe operation of the release mechanism in all operating conditions. On the other hand, the introduction of a clearance as mentioned above reduces the angular displacement 'D' required to unlatch the release mechanism. It is believed that an unlatching of the mechanism upon a rotation of the lever 74 that is substantially less than a quarter of a turn would be considered as an unpredictable release. Therefore there is an incentive to maintain the release angle, as mentioned before, as close as possible to one quarter of a turn.

It has been found that a clearance 'E' should be determined so that an angular displacement 'D' to release the hook 32 is about 80° or slightly more. This angular displacement 'D' has been found to be advantageous for providing sufficient clearance for a safe operation of the release mechanism while maintaining the release point at a predictable angular location.

Figure 8:
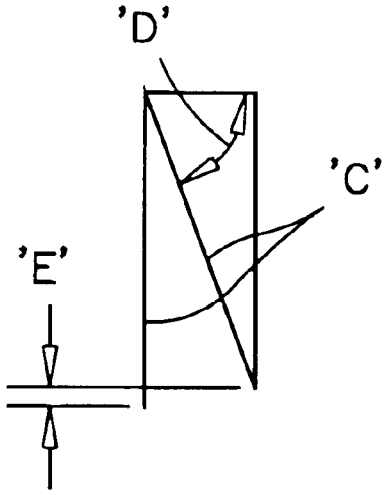
FIG. 8 is a vectorial representation of the clearance between the latch block and the lower tip of the hook heel.

The preferred method to calculate the clearance 'E' between the lower tip 84 of the hook's heel 50 and the convex surface 82 of the latch block 56, is by using the expression 'E'='C' minus ('C'×Sine 80°), as illustrated in FIG. 8.

The preferred radius of curvature 'B' of the convex surface 82 is 2.0 inches. The preferred thickness of the latch block 56 is about 1.61 inches. The preferred offset dimension 'C' is about 0.120 inch and the preferred clearance 'E' is about 0.002 inch. These dimensions can be extrapolated to manufacture release mechanisms of various sizes. The material of construction of the preferred lifeboat release mechanism is type 316 stainless steel.

It will be appreciated that because the convex surface 82 rolls against the lower tip 84 of the hook with a contact point being relatively close to the axis of rotation 86 of the bearing discs 52, 54, the unlatching of the mechanism 20 is effected without effort, and the hook 32 is retained firmly in a same position until the release angle 'D' has been reached.

As to other manner of usage and operation of the present invention, the same should be apparent from the above description and accompanying drawings, and accordingly further discussion relative to the manner of usage and operation of the invention would be considered repetitious and is not provided.

While one embodiment of the present invention has been illustrated and described herein above, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

I claim:

1. A lifeboat release mechanism comprising:

a hook having an upper end and a lower end, a concave surface on said lower end and a lower tip on said concave surface;

a pair of side plates enclosing said hook and each having a circular opening there through;

a pivot pin extending through said side plates above said circular openings and through said upper end of said hook with said hook being rotatable thereon in a release direction;

a latch block mounted between said side plates and having a convex surface thereon facing against said release direction;

a pair of bearing discs mounted in said circular openings of said side plates and being affixed to said latch block; said bearing discs being rotatable in said circular openings about a common axis of rotation;

wherein said convex surface of said latch block is mounted against said concave surface of said hook and said concave surface of said hook extends above and below said common axis of rotation.

2. The lifeboat release mechanism as claimed in claim 1, wherein said concave surface and said convex surface have a same radius of curvature.

3. The lifeboat release mechanism as claimed in claim 2, wherein said concave surface and said convex surface have a same centre of curvature.

4. The lifeboat release mechanism as claimed in claim 1, wherein said lower tip extends below said axis of rotation of said bearing discs a distance of about 0.120 inch.

5. The lifeboat release mechanism as claimed in claim 1, further comprising a safety pin extending through said side plates and said hook, between said pivot pin and said common axis of rotation.

6. The lifeboat release mechanism as claimed in claim 1, wherein said side plates have holed flanges thereon for attachment thereof to a lifeboat.

7. The lifeboat release mechanism as claimed in claim 1, further comprising means for rotating said convex surface around said lower tip.

8. A lifeboat release mechanism comprising:

a hook having an upper end and a lower end, a concave surface on said lower end and a lower tip on said concave surface;

a pair of side plates enclosing said hook and each having a circular opening there through;

a pivot pin extending through said side plates above said circular openings and through said upper end of said hook with said hook being rotatable thereon in a release direction;

a latch block mounted between said side plates and having a convex surface thereon facing against said release direction;

a pair of bearing discs mounted in said circular openings of said side plates and being affixed to said latch block; said bearing discs being rotatable in said circular openings about a common axis of rotation;

wherein said convex surface of said latch block and said concave surface of said hook are mounted against each other and have a same radius of curvature.

9. The lifeboat release mechanism as claimed in claim 8 wherein said lower tip of said hook extends below said common axis of rotation of said bearing discs.

10. The lifeboat release mechanism as claimed in claim 9 wherein a midpoint of said convex surface is offset from said common axis of rotation.

11. The lifeboat release mechanism as claimed in claim 10 wherein said midpoint on said convex surface is offset from said common axis of rotation by substantially a same distance as a distance between said lower tip and said common axis of rotation.

12. A lifeboat release mechanism comprising:

a hook having an upper end and a lower end, a concave surface on said lower end and a lower tip on said concave surface;

a pair of side plates enclosing said hook and each having a circular opening there through;

a pivot pin extending through said side plates above said circular openings and through said upper end of said hook with said hook being rotatable thereon in a release direction;

a latch block mounted between said side plates and having a convex surface thereon facing against said release direction;

a pair of bearing discs mounted in said circular openings of said side plates and being affixed to said latch block; said bearing discs being rotatable in said circular openings about a common axis of rotation;

means for rotating said latch block from a first position where said convex surface lies against said concave surface for preventing said hook from rotating on said pivot pin, and a second position where said convex surface is below said lower tip of said hook, for allowing a rotation of said hook on said pivot pin.

13. The lifeboat release mechanism as claimed in claim 12, wherein said concave surface of said hook and said convex surface of said latch block have a same radius of curvature.

14. The lifeboat release mechanism as claimed in claim 13 wherein said concave surface of said hook and said convex surface of said latch block have a same centre of curvature when said latch block is in said first position.

15. The lifeboat release mechanism as claimed in claim 14 wherein said lower tip of said hook is below said common axis of rotation of said bearing discs when said hook is in a holding position.

16. The lifeboat release mechanism as claimed in claim 15, wherein said convex surface of said latch block is below said lower tip when said latch block is in said second position.

17. The lifeboat release mechanism as claimed in claim 16 wherein said convex surface has a midpoint lying on a line between said common axis of rotation of said bearing discs and a centre of curvature of said convex surface.

18. The lifeboat release mechanism as claimed in claim 17 wherein said midpoint on said convex surface is offset from said common axis of rotation by substantially a same distance as a distance between said lower tip and said common axis of rotation.

19. The lifeboat release mechanism as claimed in claim 12, wherein said first position and said second position of said latch block are about said common axis of rotation and are separated by an angle of about 80°.

20. The lifeboat release mechanism as claimed in claim 17 wherein said midpoint on said convex surface is offset from said common axis of rotation by a same distance as a distance between said lower tip and said common axis of rotation plus a clearance dimension of about 0.002 inch.

* * * * *